United States Patent [19]

Tiffany

[11] Patent Number: 4,682,690

[45] Date of Patent: Jul. 28, 1987

[54] DISPLAY PRODUCT AND PACKAGE COMBINATION

[75] Inventor: James J. Tiffany, Roscoe, Ill.

[73] Assignee: Newell Co., Freeport, Ill.

[21] Appl. No.: 863,571

[22] Filed: May 15, 1986

[51] Int. Cl.[4] ..... B65D 73/00

[52] U.S. Cl. ..... 206/305; 206/493

[58] Field of Search ..... 206/493, 470, 305

[56] References Cited

U.S. PATENT DOCUMENTS

| | | | |
|---|---|---|---|
| 3,674,138 | 7/1972 | Gilmour | 206/493 |
| 3,963,123 | 6/1976 | Beal | 206/493 |
| 3,972,417 | 8/1976 | Iten et al. | 206/493 |
| 4,016,972 | 4/1977 | Szamborski | 206/470 |
| 4,407,413 | 10/1983 | Jansson | 206/493 |

*Primary Examiner*—Joseph Man-Fu Moy

*Attorney, Agent, or Firm*—James G. Staples

[57] ABSTRACT

A display package and display product which is firmly secured together while allowing a substantial portion of the display product to be viewed. The invention further relates to a display package which uses a fastener means to secure the display product to the display package and the method of assembling the disclosed combination.

3 Claims, 5 Drawing Figures

DISPLAY PRODUCT AND PACKAGE COMBINATION

FIELD OF THE INVENTION

This invention relates to a display package which firmly secures a display product while also allowing a substantial portion of the display product to be viewed. More particularly, the invention relates to a display package which uses a fastener means to secure the display product to the display package.

BACKGROUND OF THE INVENTION

Display packages in general have been known for some time. Consumers typically prefer such packaging, because it allows the consumer to see and sometimes feel a product before purchasing it. The display package is typically used to protect the product during transportation and storage. Further, such packaging is also sometimes used to enhance the appearance of the product.

However, consumers are typically suspicious of what they buy and often pry into packages to see whether the packaging is hiding any information which might influence their purchasing decision. Since display packages typically have substantial open portions to allow viewing, they are particularly susceptible to such prying. The display package is often placed under significant stress and strain due to consumers wishing to inspect even more of the product than is presented by the package.

Once pried open, display packages typically lose much of their ability to remain secured to their display product. When a consumer pries a product out of its display package and then replaces the product back into the package, the restraining means of the package is typically made less effective. If another consumer wishes to handle the same package and product combination, the product may fall from the packaging. Such falling typically damages the product or otherwise makes the product less desirable to consumers. Furthermore, such falling of a product may cause injury either to the consumer or to others nearby.

Some display package manufacturers use substantially flexible, clear, and transparent wrapping materials such as cellophane to aid in securing their display products to display packages. Cellophane-type materials are typically inexpensive. However, such materials can easily be torn loose from the product-package combination. If the cellophane-wrapped product is treated harshly during transportation and storage, or if consumers handle such packages in a harsh manner, the cellophane wrapping may develop holes. Once a hole is made, very little force is typically necessary to make the hole into a large tear.

Indeed, in inspecting a product, consumers will sometimes probe through a hole in the cellophane-like wrapping and often create large tears in the wrapping. Furthermore, when consumers are intent on discovering more of a product than what is displayed by such wrapping, consumers will sometimes just tear the cellophane wrapping from the display package.

Cellophane-type wrappings are typically transparent, and therefore, a consumer may not readily realize when such a wrapping has been torn away. As a result, a person may handle a package thinking that the product is secured by a cellophane-type material, only to find out later (perhaps after the product has fallen from the package) that the product was indeed no longer secured by the wrapping. All in all, cellophane-type wrappings are often undependable in securing display products to their display packages.

Some manufacturers attempt to secure their products to packages through the use of rivet-type fasteners. However, some such fasteners can easily be pried from the packaging by consumers. Further, such fasteners often require cellophane wrapping, tabs, or cutouts to restrain the product against rotational movement about the fastening means. Such restraining means are often prone to consumer tampering. Consumers will sometimes tear away the wrapping, tabs, or cutouts in order to pivot the product about the faster means for better viewing. Once free to pivot around the fastener means, a product and package combination may become somewhat more difficult to handle and perhaps become somewhat less desirable in appearance. As the package is picked up, the product may pivot and thereby cause the the consumer to lose his grip on the package. Pivoting may be decreased by placing the fastener near the center of gravity of the product; however, such placement of a fastener means may not always be convenient.

Display packaging is often useful in protecting display products from impact forces such as when the package and product are dropped. Display packages will typically protect the enclosed product better if the package and product are tightly secured to one another. Where the product is only loosely held within the package, the product will typically travel to the point of impact and absorb a large portion of the impact forces.

Display packages are meant to be viewed by consumers and are typically created to help sell the products they display. Display packages which can be displayed within easy view and reach of consumers are typically more efficient in promoting their products than display packages which are required to be placed in less convenient locations.

It is, therefore, an object of this invention to secure a display product to a display package such that the product is in substantial view of the consumer, and the package can withstand substantial prying by the consumer. A further object of this invention is to secure a product to a display package such that the product is substantially pivot free during handling. A further object of this invention is to tightly secure a display product to a package such that the combination will be relatively shock resistant. A further object of this invention is to create a display product and package combination which can be placed within easy view and easy reach of the consumer. Other objects and features of the invention will become apparent to those skilled in the art from the following specification when read in the light of the annexed drawings.

SUMMARY OF THE INVENTION

To achieve the objects of the invention and overcome the problems of the prior art, this invention utilizes a fastener means to secure a display product to a display package.

DESCRIPTION OF THE DRAWINGS

The invention is illustrated more or less diagramatically in the accompanying drawings wherein.

DESCRIPTION OF THE PREFERRED EMBODIMENT

Like reference numbers will be used to refer to like parts from Figure to Figure in the following description of a preferred embodiment of the invention.

Figure 1:
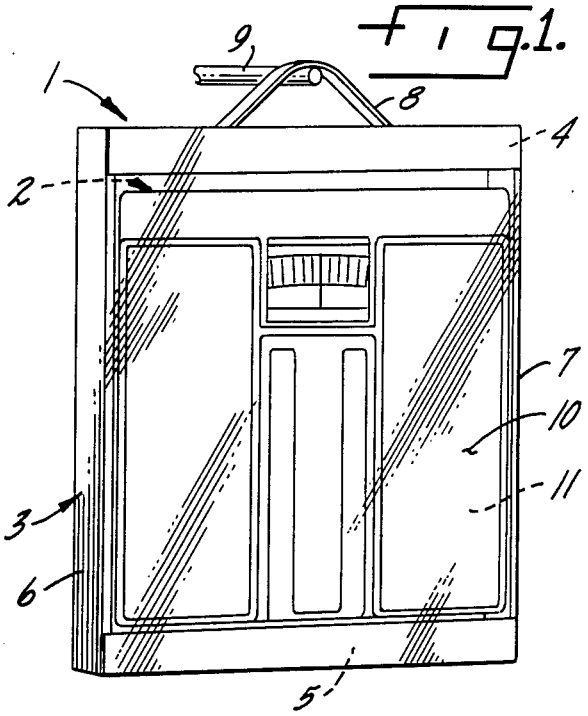
FIG. 1 is a perspective view of a preferred embodiment of the invention, disclosing a display product and package combination which would typically appear in a retail store.

The combined display product and display package of this invention is indicated generally at 1 in FIG. 1. The display product, in this instance, a conventional bathroom scale, is indicated generally at 2 and the display package is indicated generally at 3.

The display package 3 includes a top 4, bottom 5, and sidewalls 6 and 7. The top, bottom and sidewalls are formed integrally or at least interconnectedly in a manner well known in the art. As can be seen in FIG. 1, the thin sidewalls 6 and 7, the top 4, and bottom 5 are combined to form a relatively large display area in which the product can be presented. The combined display package and display product includes a handle 8 projecting from the top 4 of a size and strength suitable both to be hung from a display peg 9, and thereafter to be used by a consumer in carrying the product away.

As illustrated, a sheet or layer 10 of transparent film wrapping, such as cellophane, overlies the package. In this invention, the primary function of the film material is to protect the displayed product from dust and dirt. It is not intended as a restraining means to keep the product fast with the display package.

Figure 2:
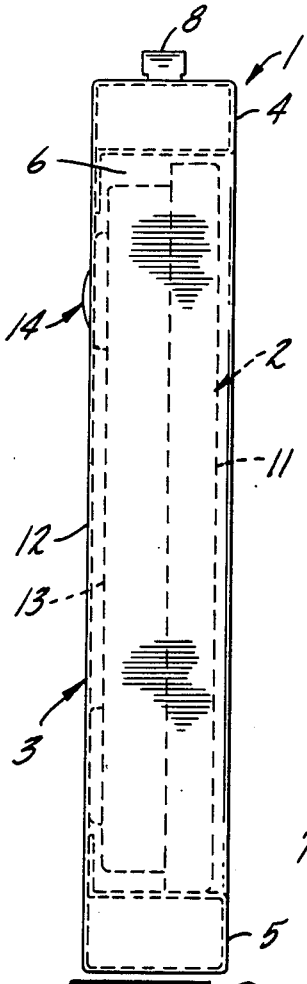
FIG. 2 is a left side view of the display product and display package combination of FIG. 1.

FIG. 2 is a left side view of FIG. 1. In FIG. 2, bathroom scale 2 is shown in broken lines as a hidden showing in order to illustrate the positioning of the bathroom scale within the display package 3. As can be seen in FIG. 2 in the preferred embodiment, the bathroom scale 2 sits recessed in the display package 3 such that only the front portion 11 of th bathroom scale 2 is left unsupported. The scale is supported at the top by display package top 4, at the bottom by display package bottom 5, at the sides by display package sidewalls 6, 7, and at the back by display package rear panel or support member 12. To keep the bathroom scale 2 from tipping out of the display package 3, the rear panel or wall 13 of the bathroom scale 2 is secured to the rear panel 12 of the display package 3 by fastener means 14. A plurality of support structures, such as conventional foot pads, are shown in dotted outline in FIG. 2, said support structures providing at least a three point stable support for the scale after it is removed from the package and placed on a supporting surface, such as a floor.

Figure 3:
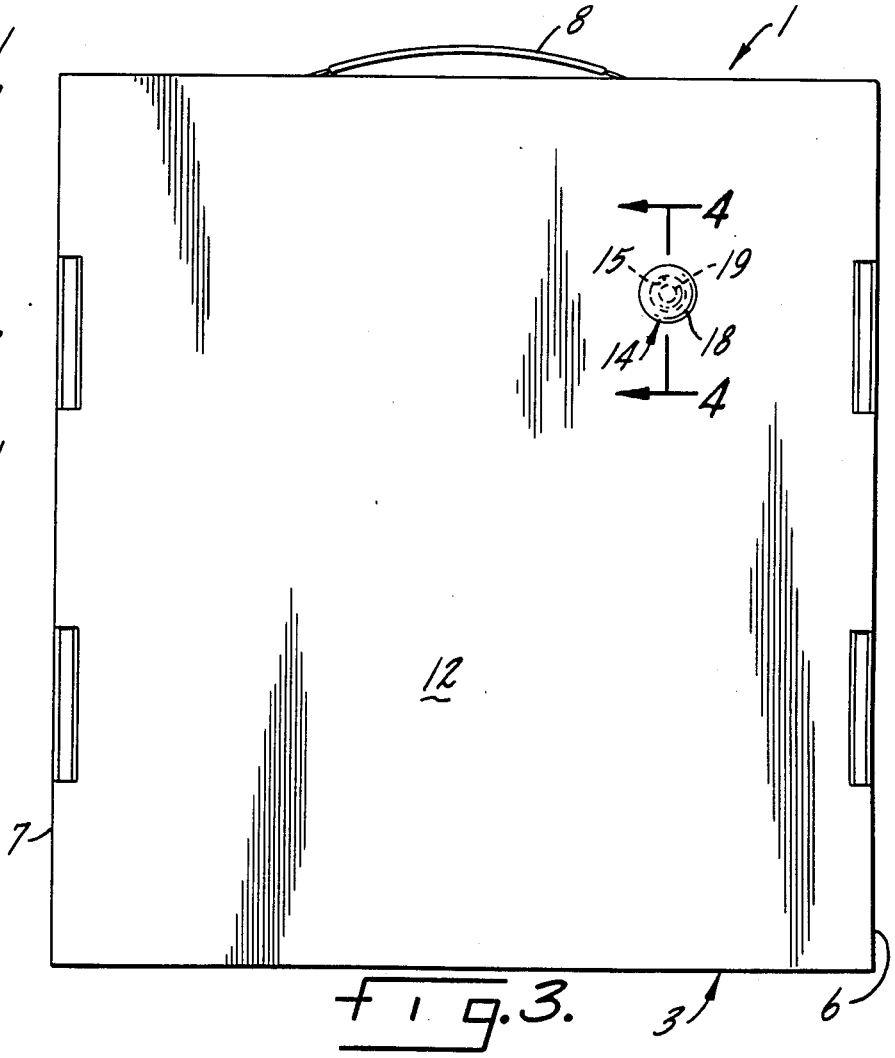
FIG. 3 is a rear view of the display product and display package combination of FIG. 1.

Whereas FIG. 2 is a view of the left side of the preferred embodiment, FIG. 3 is a rear view of this same embodiment. This rear view shows a back view of the fastener means 14, protruding from the rear panel 12 of the display package 3. As can be seen in this Figure (FIG. 3), the rear panel 12 of the display package 3 contains an aperture 15 sometimes hereafter referred to as first aperture means, which lies underneath the first end portion or head 18 of fastener means 14. Furthermore, bathroom scale aperture sometimes hereafter referred to as second aperture means, 17 lies in alignment with display package aperture 15.

Figure 4:
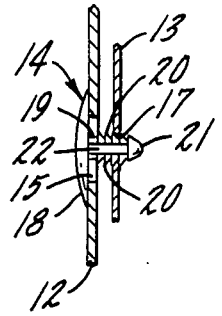
FIG. 4 is a detailed view to an enlarged scale of a fastener means used in the preferred embodiment of the invention taken substantially along the line 4—4 of FIG. 3.

As can be seen in FIG. 4, the fastener means 14 in the preferred embodiment comprises an oversized first end portion or head 18 which precludes the fastener means 14 from being forced through aperture 15 of the rear panel 12 of the display package 3.

The second end portion 21 of fastener means 14 is a rounded point which can slide through apertures 15 and 17. The middle shank 19 of fastener means 14 contains protruding portions 20. Each protruding portion or skirt 20 is structured such that, as fastener means 14 enters aperture 17, the resistence of the aperture 17 upon each protruding portion or skirt 20 forces the skirt to deform or bend back away from the aperture 17, thereby allowing the middle shank portion 19 to slide through the aperture 17 in the rear wall 13 of the bathroom scale until the underside of head 18 engages the rear panel 12. However, when the bathroom scale 2 is pulled either by a consumer or otherwise, the shank portion 19 will resist being pulled back out of the bathroom scale aperture 17, because the protruding skirt portions 20, when pulled against bathroom scale aperture 17 in the opposite direction, flare outwardly. Thus, the fastener means 14 can function as a one-way fastener. It will be noted that the footpads project outwardly from the product wall 13 a greater distance than the thickness of head 18. As a consequence, when the rear panel wall 12 is removed and the fastener means 14 pushed to the right as viewed in FIG. 4, as far as possible in those instances when the fastener remains with the product, the footpads will extend outwardly from the product wall 13 a greater distance than head 18 and will not disturb the support of the product by the footpads.

In the preferred embodiment, the protruding or skirt portion 20 is preferably made of nylon. However, any similar type material can be used where the material is sufficiently pliable to allow compression of the protrusions in the pressing of the protruding portion in a forward direction through an aperture of smaller diameter, and further, where the material is sufficiently rigid to substantially hinder a pull on the protruding or skirt portion through such an aperture in an opposite or rearward direction.

Figure 5:
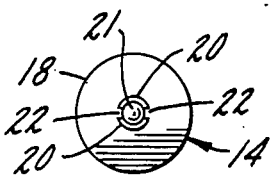
FIG. 5 is a front view of the fastener means of FIG. 4.

FIG. 5 is a front view of the fastener means 14. In this preferred embodiment, the skirt portions 20 have a notch or groove 22. This groove 22 gives the skirt portions 20 flexibility such that the skirt will readily compress when pushed forward through aperture 17 and will then flare outwardly if pulled back in a rearward direction.

In use, this preferred embodiment of the invention is preferably hung by its display handle on a store display peg, positioning it within easy sight and reach of potential buyers. These buyers are typically able to examine the package and product combination by merely pulling the combined bathroom scale and display package from the display peg, usually by its handle.

Due to the side supports and fastener means, the bathroom scale is firmly secured to the display package. Consumers will typically not be unable to pry the bathroom scale from its packaging prior to purchase. If the cellophane is removed, the product will not fall forward. Once the product is purchased, the packaging can usually be seperated from the bathroom scale by use of a screwdriver or cutting by cutting.

This disclosure relates to only the preferred embodiment of the invention and numerous modifications or alterations may be made therein without parting from the spirit and scope of the invention as set forth in the appended claims.

I claim:

1. In combination:

a display package and a product to be displayed, said display package having a support member arranged to be located behind the product to be displayed when the package and product are assembled for display, said product having a wall which forms part of the product and so arranged as to lie in opposing relationship to the support member of the display package when the package and product are assembled for display, support structures which provide at least three point support for the product when said product is separated from the display package and placed upon a supporting surface, said support structures extending outwardly from the said product wall whereby the product, when placed on the supporting surface, is located a given distance from the supporting surface, first aperture means in the support member of the display package and second aperture means in the product wall, said first and second aperture means being axially aligned with one another when the package and product are assembled for display, fastener means received in the first and second aperture means and arranged to maintain the package and product in fixed, spaced relationship to one another when the package and product are assembled for display, the outermost extremity of the fastener means extending outwardly beyond the product wall a distance up to and including a distance greater than the distance the support structures extend outwardly from said product wall when the product has been removed from the package when there is no change in the spatial relationship between the fastener means and the product, said fastener means having insertion means which enable the fastener means to be moved toward the product to a position in which the outwardmost extremity of the fastener means is located closer to the product wall than the support structures.

2. The combination of claim 1 further characterized in that the one way fastener means includes a head portion and a shank portion, the shank portion being received in the second aperture means in the product, said shank portion being received in the product wall and having protrusion means which, in co-operation with the second aperture means, enable the one way fastener means to be moved toward the product, but which resist movement of the fastener means away from the product.

3. The combination of either claim 1 or claim 2 further characterized in that the product is a bathroom scale.

* * * * *